US012722750B2

(12) United States Patent
Zhou

(10) Patent No.: US 12,722,750 B2
(45) Date of Patent: Sep. 1, 2026

(54) BABY FLOAT WITH BABY CARRIER

(71) Applicant: Zhejiang Mambobaby Baby Products Co., Ltd., Yiwu (CN)

(72) Inventor: Weixin Zhou, Yiwu (CN)

(73) Assignee: Zhejiang Mambobaby Baby Products Co., Ltd., Yiwu (CN)

( * ) Notice: Subject to any disclaimer, the term of this patent is extended or adjusted under 35 U.S.C. 154(b) by 352 days.

(21) Appl. No.: 18/584,046

(22) Filed: Feb. 22, 2024

(65) Prior Publication Data

US 2024/0190540 A1 Jun. 13, 2024

(30) Foreign Application Priority Data

Dec. 27, 2023 (CN) ..... 202323591972.6

(51) Int. Cl.
*B63B 34/50* (2020.01)
*A47D 13/02* (2006.01)

(52) U.S. Cl.
CPC ..... *B63B 34/50* (2020.02); *A47D 13/02* (2013.01)

(58) Field of Classification Search
CPC ..... B63B 34/00; B63B 34/50; B63B 34/52; A47D 13/00; A47D 13/02; A47D 13/025
USPC ..... 441/129, 130, 131, 132; 224/101, 153, 224/155, 158, 159, 160, 161
See application file for complete search history.

(56) References Cited

U.S. PATENT DOCUMENTS 5,143,420 A * 9/1992 Switlik ..... A47D 1/10 297/488
6,575,342 B1 * 6/2003 Sundara ..... A47D 13/025 224/160
7,255,620 B1 * 8/2007 Shepherd ..... B63C 9/115 441/106
2005/0076856 A1 * 4/2005 Bruck ..... A47D 13/025 119/770
2006/0025029 A1 2/2006 Berenson
2022/0111942 A1 4/2022 Zhou
2022/0234695 A1 7/2022 Zhou

FOREIGN PATENT DOCUMENTS

CN 216468375 U 5/2021

* cited by examiner

*Primary Examiner* — Daniel V Venne
(74) *Attorney, Agent, or Firm* — Birchwood IP

(57) ABSTRACT

The present invention discloses a baby float with a baby carrier, comprising a float body. A U-shaped inner ring is arranged at an inner side of the float body; a fixing device is detachably installed in the U-shaped inner ring; and the fixing device is provided with adult shoulder straps. In the present invention, the fixing device is detachably installed on the baby float; when the float is not needed, the fixing device can be disassembled separately, and the fixing device that fixes a baby is carried on a body through the adult shoulder straps to carry the baby separately, which is very convenient.

5 Claims, 2 Drawing Sheets

BABY FLOAT WITH BABY CARRIER

TECHNICAL FIELD

The present invention relates to the technical field of a float, in particular to the technical field of a baby float.

BACKGROUND

Swimming can effectively promote the development of brains and nervous systems of infants, stimulate the potential of infants, and lay a good foundation for improving emotion quotient and intelligence quotient of children, and can also enhance myocardial functions, enhance resistance and strengthen lung functions. For infants, a swimming lying ring is an essential swimming aid, and can adapt to the use needs of infants over 3 months old in water.

The patent document CN216468375U discloses a multi-functional baby float, which is fixed with safety belts for fixing a baby. The safety belt structure can fix the baby into the float to strengthen the fixation for the baby. However, this safety belt cannot be disassembled from the float, which is not convenient for people to carry the baby and cannot meet the diverse needs of people.

SUMMARY

A purpose of the present invention is to solve the problems in the prior art, to provide a baby float with a baby carrier, which can solve the above problems.

In order to achieve the above purpose, the present invention provides a baby float with a baby carrier, comprising a float body; a U-shaped inner ring is arranged at an inner side of the float body; a fixing device is detachably installed in the U-shaped inner ring; and the fixing device is provided with adult shoulder straps.

Preferably, the fixing device comprises a rear supporting pad, a front protecting pad and baby shoulder straps, and a top of the rear supporting pad and a top of the front protecting pad are detachably connected by the baby shoulder straps.

Preferably, both sides of the fixing device are provided with the adult shoulder straps, and the adult shoulder straps are fixed on the rear supporting pad or the front protecting pad.

Preferably, the adult shoulder straps are adjustable adult shoulder straps.

Preferably, an outer edge of the fixing device is provided with a connecting structure, and the connecting structure and the U-shaped inner ring are detachably installed.

Preferably, the connecting structure is a zipper.

The present invention has beneficial effects that: in the present invention, the fixing device is detachably installed on the baby float; when the float is not needed, the fixing device can be disassembled separately, and the fixing device that fixes the baby is carried on a body through the adult shoulder straps to carry the baby separately, which is very convenient.

The features and advantages of the present invention will be described in detail through embodiments in combination with drawings.

In the figures: 1—float body, 2—U-shaped inner ring, 3—fixing device, 4—adult shoulder strap, 5—connecting structure, 31—rear supporting pad, 32—front protecting pad, 33—baby shoulder strap.

DETAILED DESCRIPTION

Embodiment 1

Figure 1:
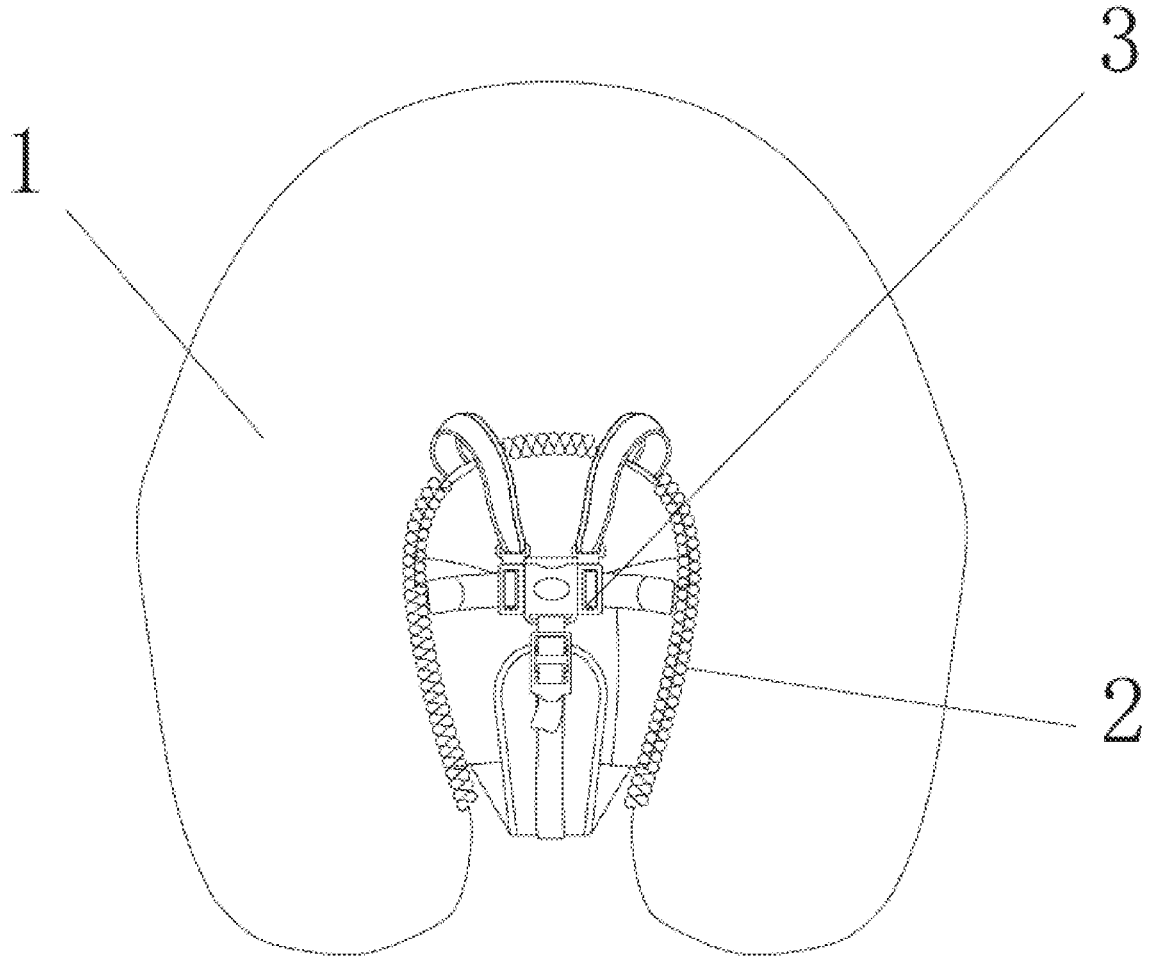
FIG. 1 is a structural schematic diagram of the present invention.
Figure 2:
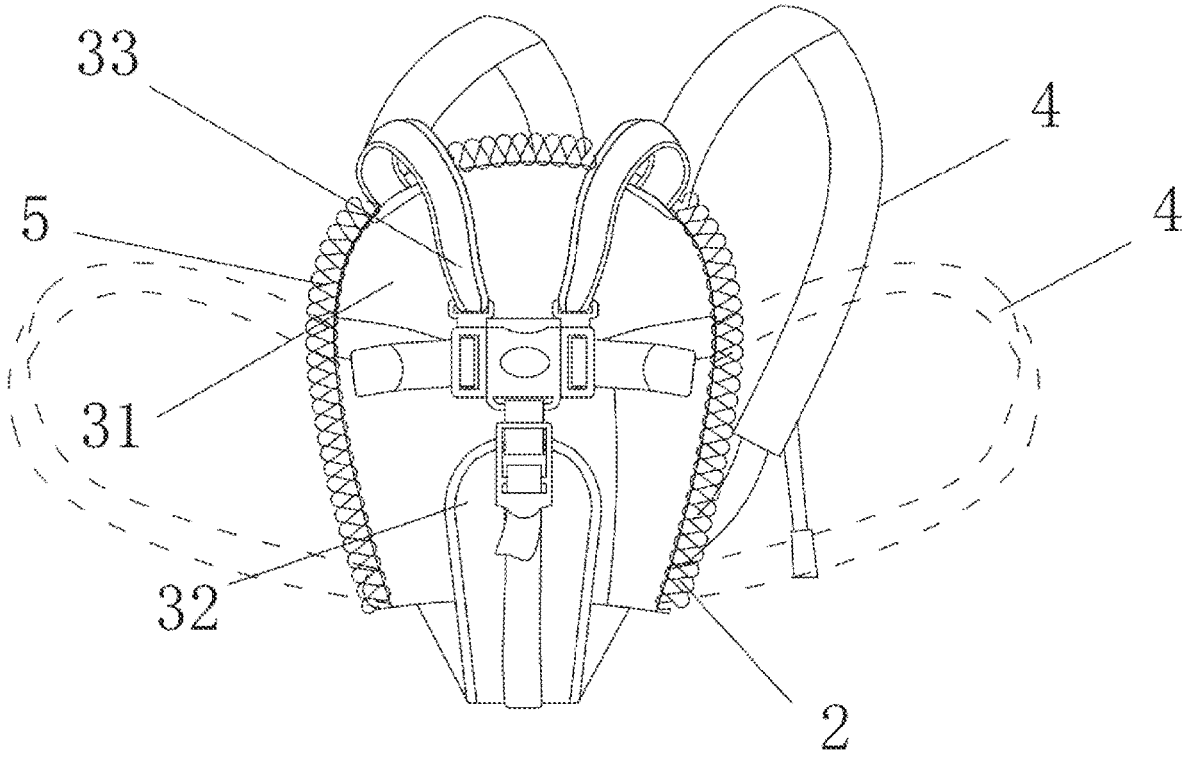
FIG. 2 is a schematic diagram of adult shoulder straps of the present invention.

By referring to FIG. 1 and FIG. 2, a baby float with a baby carrier comprises a float body 1; a U-shaped inner ring 2 is arranged at an inner side of the float body 1; a fixing device 3 is detachably installed in the U-shaped inner ring 2; and the fixing device 3 is provided with adult shoulder straps 4. The fixing device 3 comprises a rear supporting pad 31, a front protecting pad 32 and baby shoulder straps 33, a bottom of the rear supporting pad 31 and a bottom of the front protecting pad 32 are connected, and a top of the rear supporting pad 31 and a top of the front protecting pad 32 are detachably connected by the baby shoulder straps 33. Both sides of the fixing device 3 are provided with the adult shoulder straps 4, and the adult shoulder straps 4 are adjustable adult shoulder straps. An outer edge of the fixing device 3 is provided with a connecting structure 5, and the connecting structure 5 and the U-shaped inner ring 2 are detachably installed. The connecting structure 5 is a zipper. The rear supporting pad 31 and the front protecting pad 32 are one-piece structures. Left and right sides of the U-shaped inner ring 2 are provided with abdominal fixing sheets, and two abdominal fixing sheets are fixed by hook and loop fasteners. One end of the baby shoulder strap is connected with the rear supporting pad 31, and the other end is connected with the front protecting pad 32 by a connecting buckle.

Embodiment 2

A baby float with a baby carrier comprises a float body 1; a U-shaped inner ring 2 is arranged at an inner side of the float body 1; a fixing device 3 is detachably installed in the U-shaped inner ring 2; and the fixing device 3 is provided with adult shoulder straps 4. The fixing device 3 comprises a rear supporting pad 31, a front protecting pad 32 and baby shoulder straps 33. The rear supporting pad 31 and the front protecting pad 32 are one-piece structures. The front protecting pad 32 is integrally connected with abdominal fixing sheets. A top of the rear supporting pad 31 and a top of the front protecting pad 32 are detachably connected by the baby shoulder straps 33. Both sides of the fixing device are provided with the adult shoulder straps 4, and the adult shoulder straps 4 are adjustable adult shoulder straps. An outer edge of the fixing device 3 is provided with a connecting structure 5, and the connecting structure 5 and the U-shaped inner ring 2 are detachably installed. The connecting structure 5 is a zipper. Side surfaces of the rear supporting pad 31 and the front protecting pad 32 are detachably connected.

The above embodiments describe the present invention, and do not limit the present invention. Any solution after simple transformation of the present invention belongs to the protection scope of the present invention.

What is claimed is:

1. A baby float with a baby carrier, comprising: a float body, wherein a U-shaped inner ring is arranged at an inner side of the float body; a fixing device is detachably installed in the U-shaped inner ring; and the fixing device is provided with adult shoulder straps;

wherein the fixing device comprises a rear supporting pad, a front protecting pad and baby shoulder straps, and a top of the rear supporting pad and a top of the front protecting pad are detachably connected by the baby shoulder straps.

2. The baby float with the baby carrier according to claim 1, wherein two sides of the fixing device are provided with the adult shoulder straps.

3. The baby float with the baby carrier according to claim 1, wherein the adult shoulder straps are adjustable adult shoulder straps.

4. The baby float with the baby carrier according to claim 1, wherein an outer edge of the fixing device is provided with a connecting structure, and the connecting structure and the U-shaped inner ring are detachably installed.

5. The baby float with the baby carrier according to claim 4, wherein the connecting structure is a zipper.

* * * * *